US005388973A

United States Patent [19]

Richardson, Jr.

[11] Patent Number: 5,388,973

[45] Date of Patent: Feb. 14, 1995

[54] VARIABLE SCROLL TIP HARDNESS

[75] Inventor: Hubert Richardson, Jr., Brooklyn, Mich.

[73] Assignee: Tecumseh Products Company, Tecumseh, Mich.

[21] Appl. No.: 254,184

[22] Filed: Jun. 6, 1994

[51] Int. Cl.[6] ..... F01C 1/04

[52] U.S. Cl. ..... 418/55.2; 29/888.02; 164/122; 164/137; 164/348

[58] Field of Search ..... 418/55.2; 29/888.02; 164/122, 137, 348

[56] References Cited

U.S. PATENT DOCUMENTS

| | | | |
|---|---|---|---|
| 4,456,051 | 6/1984 | Hukuhara | 164/137 |
| 4,457,674 | 7/1984 | Kawano | 418/5 |
| 4,472,120 | 9/1984 | McCullough | 418/55 |
| 4,477,238 | 10/1984 | Terauchi | 418/5 |
| 4,548,555 | 10/1985 | Hiraga | 418/55 |
| 4,767,293 | 8/1988 | Caillat | 418/55 |

FOREIGN PATENT DOCUMENTS

| | | | |
|---|---|---|---|
| 077214 | 4/1983 | European Pat. Off. . | |
| 58-62395 | 4/1983 | Japan . | |
| 58-133491 | 9/1983 | Japan . | |
| 59-176483 | 10/1984 | Japan . | |
| 0098186 | 6/1985 | Japan | 418/55.2 |
| 63-306290 | 12/1988 | Japan . | |
| 2-275085 | 11/1990 | Japan . | |
| 3264789 | 11/1991 | Japan | 418/55.2 |
| 2143904 | 2/1985 | United Kingdom . | |

*Primary Examiner*—Richard A. Bertsch
*Assistant Examiner*—Charles G. Freay
*Attorney, Agent, or Firm*—Baker & Daniels

[57] ABSTRACT

A process of casting a scroll member for a scroll compressor including forming the scroll wrap member portions of equal height. Unequal cooling of the scroll wrap when formed causes the hardness of the wrap to vary from radially outside to radially inside. The radially outside portions of the scroll wrap are formed harder therefore reducing wear-out of the scroll member while the radially inside portions are formed softer, thereby permitting quicker run-in of the scroll set during initial startup of the scroll compressor.

9 Claims, 3 Drawing Sheets

VARIABLE SCROLL TIP HARDNESS

BACKGROUND OF THE INVENTION

The present invention relates generally to hermetic scroll type compressors, and more particularly, to such a compressor having fixed and orbiting scroll members created by metal casting methods.

A typical scroll compressor comprises two facing scroll members, each having a wrap member, wherein the respective wraps are interfit to define a plurality of closed compression pockets. When one of the scroll members is orbited relative to the other, the pockets decrease in volume as they travel between a radially outer suction port and a radially inner discharge port, thereby conveying and compressing the refrigerant fluid.

A present problem with scroll members and that of associated scroll compressors is that of a lengthy wear-in or run-in time. Run-in time is the amount of time the compressor is required to be operated until the compressor mechanism reaches its designed efficiency rating. This run-in operation is inefficient, requiring the scroll compressor to be run-in at the purchaser's site after installation.

An additional problem exists with wear out of the scroll wraps. Uncompensated forces within the compressor can cause the scroll members to literally grind themselves together, leading to scroll members that are incapable of properly compressing fluid.

Prior attempts to solve the aforementioned problems comprised methods of creating a very hard scroll member or creating a scroll member having wrap tips having an even hardness. To create an even hardness over the scroll wrap tips, the inside scroll wrap sections were cast at a height greater than the outside wrap sections to create variable height wraps. Because of uneven cooling after casting, the variable height wraps of the casting caused the scroll member wrap member to form a flat, internal layer of substantially even hardness. By selectively milling portions of the scroll member, this layer of even hardness is brought to the surface so that it may wear against an opposing scroll member as is known in the art. If the wraps were cast even in height, after milling to a flat surface, the hardness would be uneven and this was considered undesirable.

The present invention solves the aforementioned problems providing a compressor with better run-in time and wear control by casting the scroll wraps level so that, when machined, the radially outer wraps are harder than the radially inner wraps.

SUMMARY OF THE INVENTION

The present invention overcomes the disadvantages of the prior art scroll type compressors by providing an improved casting method in which the scroll wrap tips are cast level with each other, so that when machined or milled, the hardness of the scroll wrap tips are non-uniform.

Generally, the invention provides casting the scroll members of a scroll compressor so that the wrap sections are uniform or even in height. During the cooling cycle of the casting process, the scroll wrap geometry and other factors create a gradient cooling rate extending radially along the scroll wrap. By casting the scroll member in the aforementioned fashion, the unequal cooling of the wrap member cause the hardness of the metal scroll wrap to vary, from radially outside to radially inside at a particular wrap height.

In one form of the invention, a scroll member is cast with the wrap member level across the entire top surface. By allowing the scroll wrap to cool in its mold, uneven cooling will take place because of the particular geometry of the scroll wrap. Different wrap or base plate thicknesses and materials will vary the cooling rate. This uneven cooling will cause the hardness of the scroll wrap to vary from a harder radially outside wrap portion to a softer radially inner wrap portion.

In another form of the invention, the portions of the scroll wrap may be intentionally cooled faster than other portions thereby altering the hardness of the scroll wrap.

An advantage of the method and scroll member of the present invention, according to one form thereof, is that of reducing the run-in time of the scroll members within a scroll compressor. By causing the radially inner wrap tips to be softer than the outer wrap tips, the inner wrap tips will wear quickly, conforming to the precise shape needed to seal with an opposing scroll member.

Another advantage of the scroll compressor of the present invention is that of improved wear control of the scroll wrap member. The radially outer wrap tips formed harder than the radially inner wrap tips will resist wear. Additionally, when the outer wrap tips engage an opposing scroll member, they will halt or diminish the wear in of the radially inner wrap tips.

A further advantage of the method of the present invention is that current casting techniques need not be greatly altered to solve the scroll design problems of run-in and wear control. By slightly altering the shape of the scroll member and wrap mold, the hardness levels of the scroll member needed for proper compressor operation are created.

The invention, in one form thereof, comprises a process for manufacturing a scroll member with a radially inner wrap portion and radially outer wrap portion including the steps of providing a mold to cast the scroll member, casting the scroll member so that the radially inner wrap portion is even in height with the radially outer wrap portion and unequally cooling the radially inner wrap portion and radially outer wrap portion whereby the unequal cooling causes the radially outer wrap portion to form harder than the radially inner wrap portion.

The invention, in another form thereof, comprises a scroll member for a scroll compressor comprising a base plate and an upstanding involute wrap cast with the base plate. The wrap includes a radially inner wrap portion and a radially outer wrap portion. The radially inner wrap portion is formed from a softer material than the radially outer wrap portion.

The invention, in another form thereof, comprises a scroll member including a base member of cast iron with an upstanding involute wrap having a radially inner wrap portion and a radially outer wrap portion formed on the base by casting and unevenly cooling the base plate and the wrap together whereby the radially inner wrap portions are softer than the radially outer wrap portions.

BRIEF DESCRIPTION OF THE DRAWINGS

The above mentioned and other features and objects of this invention, and the manner of attaining them, will become more apparent and the invention itself will be better understood by reference to the following description of embodiments of the invention taken in conjunction with the accompanying drawings, wherein.

Figure 1:
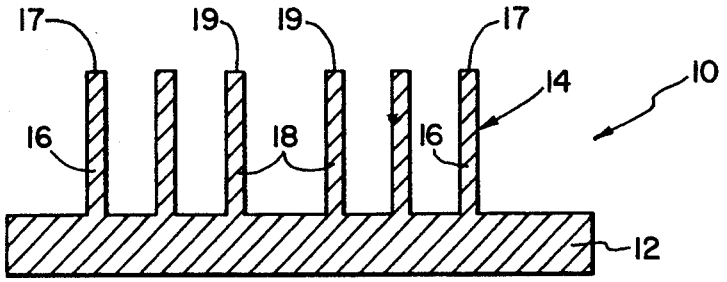
FIG. 1 is a sectional view of a scroll member of a scroll compressor.

Corresponding reference characters indicate corresponding parts throughout the several views. The exemplifications set out herein illustrate a preferred embodiment of the invention, in one form thereof, and such exemplifications are not to be construed as limiting the scope of the invention in any manner.

DESCRIPTION OF THE PREFERRED EMBODIMENT

Figure 2:
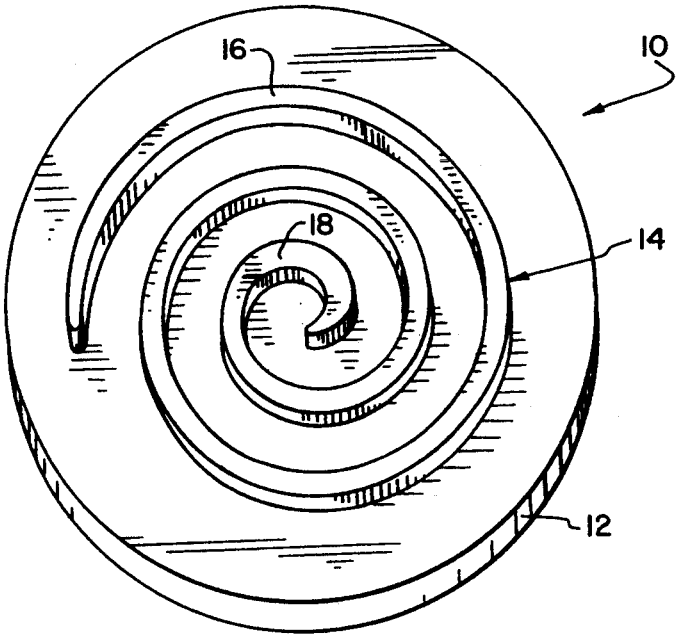
FIG. 2 is a perspective view of the scroll member of FIG. 1.

Referring now to FIGS. 1 and 2, there is shown a scroll member 10 comprising a base plate 12 along with a scroll wrap 14 cast together. As shown in FIG. 1 in sectional view, scroll wrap 14 comprises an outer wrap portion 16 and inner wrap portion 18. The description of the wrap portions relate to their relative radial location from the center of base plate 12. Outer wrap portion 16 includes an outer wrap tip 17 and the inner wrap portion 18 includes an inner wrap tip 19. Although scroll member 10 of FIGS. 1 and 2 is shown with approximately two involutes of scroll wrap 14, it is known in the art to include more or fewer involutes to vary the design compression ratio of scroll member 10. The terms outer wrap portion 16 and inner wrap portion 18 are used only to define particular sections of scroll wrap 14 and not meant to limit themselves to precisely the most radially outward wrap or the most radially inward wrap portion.

Scroll member 10 may be used in known scroll compressors of the type shown and described in assignee's U.S. Pat. No. 5,131,828, the disclosure of which is incorporated herein by reference.

Figure 3:
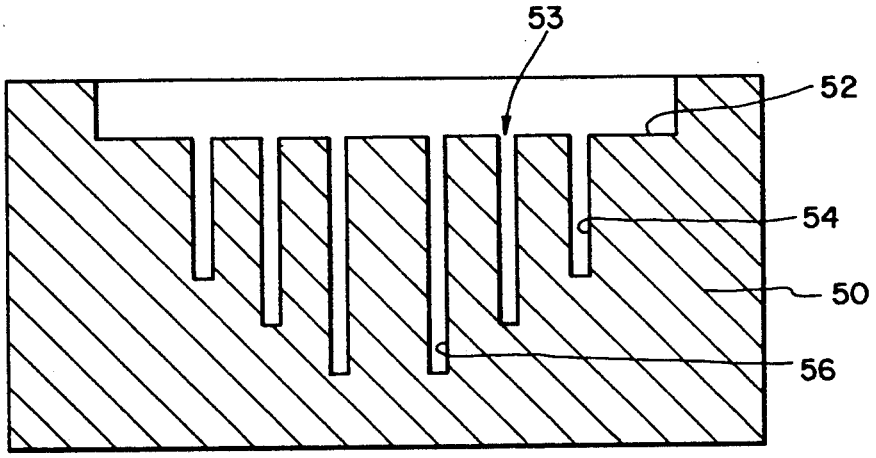
PRIOR ART FIG. 3
FIG. 3 is a sectional view of a prior art scroll member mold.
Figure 4:
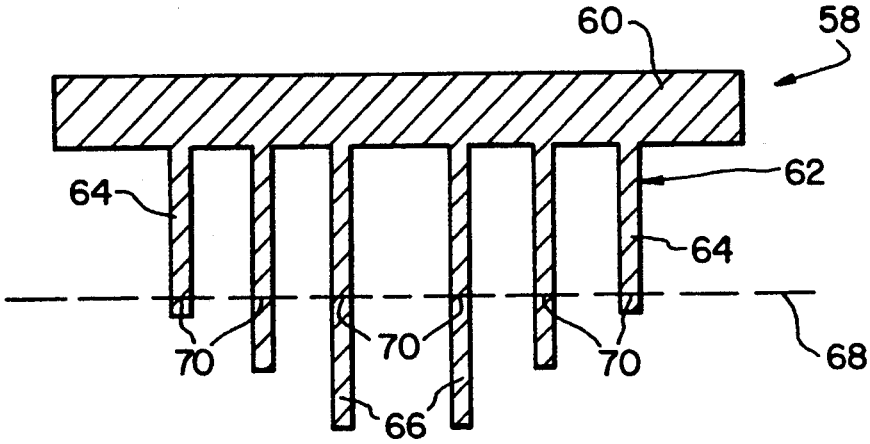
PRIOR ART FIG. 4
FIG. 4 is a sectional view of a prior art scroll member casting.

Although the prior art was described in the background section, to more clearly illustrate the differences between the present invention and prior art, the prior art casting mold and cast scroll member are shown in FIGS. 3 and 4. FIG. 3 shows, in sectional view, a mold 50 for casting scroll member 58. As shown, there is included a base plate cavity 52 in mold 50 to cast the base plate 60 of scroll member 58. Further, there is an involute shaped cavity 53 to permit a scroll wrap 62 to be cast integrally with scroll base plate 60. Cavity 53 includes outer wrap sections 54 and inner wrap sections 56.

Scroll member 58 cast from mold 50 of FIG. 3 is shown in FIG. 4. This prior art cast scroll member 58 includes a base plate 60 along with integral scroll wrap 62. Outer wrap portion 64 spirals into the center to become inner wrap portion 66.

The prior practice of casting scroll member 58 so that the inner wrap portion 66 was of greater height than the outer wrap portion 64 was conducted to ensure that the metallurgy of the scroll wrap tips 70, after machining, were of uniform hardness.

The hardness of scroll member 58 varies with the rate of cooling after casting. Because of the shape of a scroll member, it does not cool evenly, thereby creating portions of varying hardness. Prior scroll compressor manufacturers deemed it necessary to have an even hardness along the scroll wrap tips 70. To do this, the scroll manufacturer increased the height of the radially inner wrap portions 66 so that after cooling, a flat plane through wrap member 62 would intersect portions of even hardness. Scroll member 58 was then machined to this flat plane, or as shown in FIG. 4, milling line 68.

It was known that during operation of the scroll compressor, the wrap tips 70 from inner wrap sections 66 thermally expanded due to proximity to hot compressed refrigerant. This expansion leads to greater generation of heat due to increased friction between the interfit scroll members. These prior attempts to create even hardness wrap tips were undertaken because it was thought that if the wrap tip was of a constant metallurgy or constant hardness the scroll wrap would run-in faster and prevent premature failure or wear out of the scroll wrap member 58.

Figure 5:
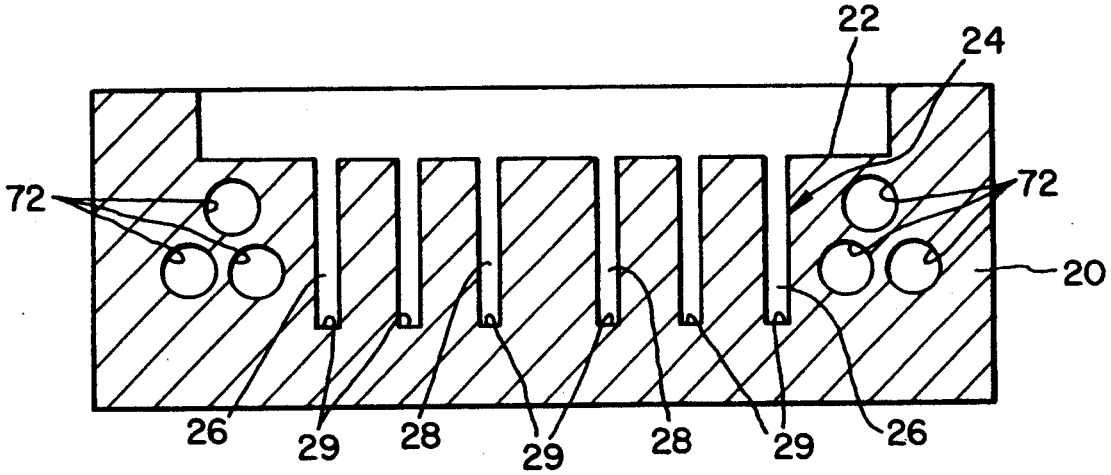
FIG. 5 is a sectional view of the scroll member mold used in casting the scroll member according to the present invention, in one form thereof.
Figure 6:
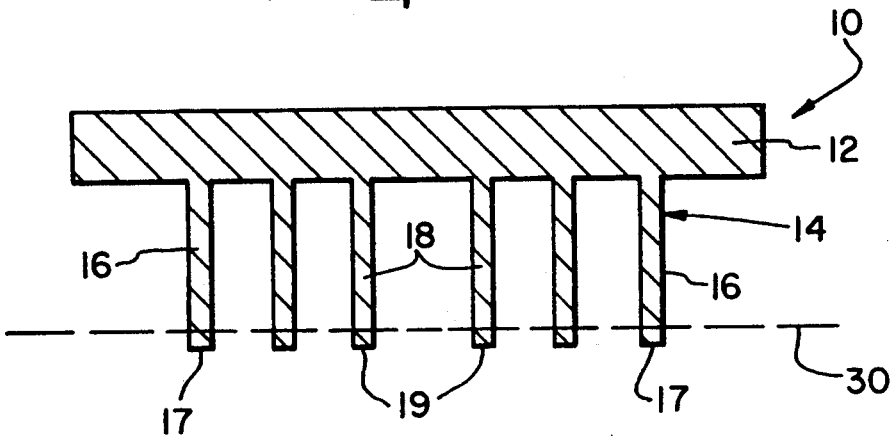
FIG. 6 is a sectional view of the scroll member formed from the scroll member mold of FIG. 5.
Figure 7:
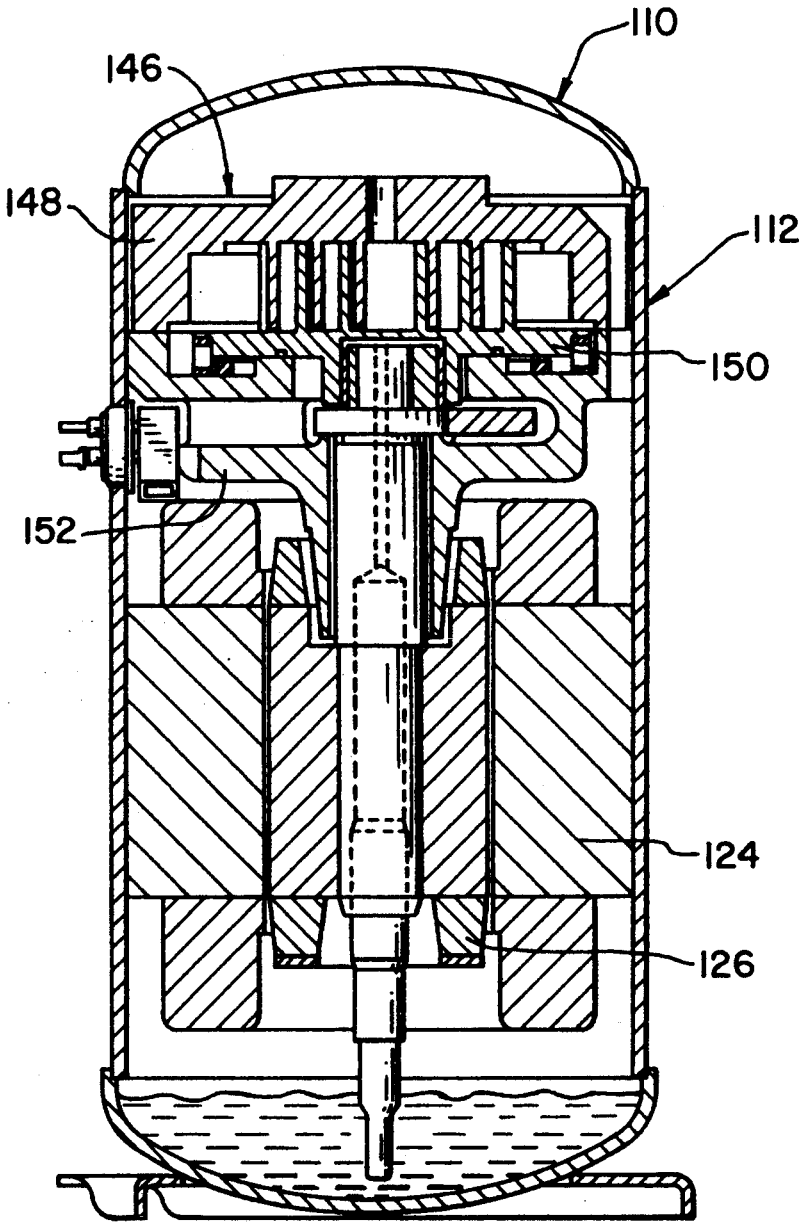
FIG. 7 is a longitudinal sectional view of a compressor incorporating a scroll member in accordance with the present invention.

The present invention, as shown in FIGS. 5 and 6, permits scroll member 10 to be monolithically molded in one piece with a flat base plate 12 and scroll wrap 14. As shown in FIG. 5, the scroll member mold 20 includes a cavity for molding scroll member 10 comprising a base member cavity 22 along with an involute shaped wrap member cavity 24. Wrap member cavity 24 is shown in sectional view in FIG. 5 where it can be seen that sections of wrap cavity 24, particularly inner wrap portion cavity 28, are radially inward from outer wrap portion cavity 26. As shown in FIG. 5, the wrap member cavity 24 is of substantially equal depth around the entire length of the cavity so that the bottom of the wrap member cavity 29 is substantially even. As shown in FIG. 6, this even depth will create scroll wrap tips 17 and 19 of substantially equal height, which when cooled in mold 20 will wrap tips 17 to create a variable hardness in the scroll wraps from radially outer scroll member 10 to radially inner wrap tips 19 along plane 30. Specifically, the radially outer wrap portion 16 cooling faster than radially inner wrap portion 18. Scroll member 10 will cool at different rates therefore creating portions of wrap member 14 of different hardness. This plane, represented by mill line 30, is of variable hardness, and is the depth to which machining will take place after removal of scroll member 10 from mold 50. By machining to plane 30, the variable hardness portions of wrap 14 will lie on the tip contact surface of scroll member 14.

One of the features of the present invention, particularly when using a cast iron material, is that the center wrap tips (inner wrap tips 19) will cool more slowly, thereby having more ferrite and less pearlite than outer wrap tips 17. Outer wrap tips 17 will cool faster, therefore having more pearlite than ferrite. Pearlite being harder then ferrite will cause outer wrap tips 17 to be harder than inner wrap tips 19. By having the wrap tips softer in the center, the run-in process on this portion of cast iron scroll wrap 14 during initial start up of the scroll compressor will be accelerated. Scroll member 10 will tend to wear by contacting near the center first, because of the increased heat and thermal expansion, then wearing until contact occurs at the radially outside scroll wraps 16. Since inner wrap tips 17 are relatively soft, they will quickly wear to the desired size. Once radially inner wraps 18 have acquired the desired geometry through incremental run-in, the harder outer wrap tips and wrap surfaces 16 and 17 will decrease the run-in and wear out process of scroll 10 by engaging the opposite scroll member base plate of the compressor. A near perfect match between two scroll members of the type described will automatically be created by two such scroll members 10 wearing together. The scroll set in the compressor is then in natural compliance. This process may reduces the level of tolerance requirements.

By casting the scroll wrap 14 flat, or in other words even in height and controlling the cooling process, it is possible to control the graphite size, i.e, the amount of ferrite and the amount of pearlite along with the flake size, thereby controlling the hardness of the cast material.

The process of changing the metallurgy from radially inside to radially outside of the scroll wrap member is caused by a cooling effect of the poured steel within mold 20 and cooling rate from outside to inside. Additionally, it may be possible to increase or further control the cooling of the scroll wrap by flooding portions of mold 50, such as water jacket 72 comprising a plurality of conduits through mold 50 with a cool fluid such as water.

Additionally, enhanced run-in has been evident with the present process with an initial doping of the scroll contact surfaces with LUBRIGHT. LUBRIGHT is a trade name for a dry magnesium iron phosphate lubricant coating from Parker & Amchem of Madison Heights, Mich. that has been known to improve metal to metal wear characteristics. Equivalently, other types of lubricants may be used on the scroll members to enhance run-in.

Compressor 110 includes a scroll compressor mechanism 46 drivingly connected to electric motor 122 disposed within housing 112. The compressor mechanism 146 comprises a fixed scroll member 148 and orbiting scroll member 150 along with main bearing frame member 52. The fixed scroll member 146 and orbiting scroll member 150 are formed utilizing the above disclosed casting method.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A process for manufacturing a scroll member with a radially inner wrap portion and a radially outer wrap portion, said process comprising the steps of:

providing a mold to cast the scroll member;

casting the scroll wrap so that said radially inner wrap portion is even in height with said radially outer wrap portion; and unequally cooling said radially inner wrap portions and said radially outer wrap portions whereby said unequal cooling causes said radially outer wrap portions to become harder than said radially inner wrap portions.

2. The process of claim 1 further comprising the step of heating the outer wrap portions during casting.

3. The process of claim 1 further comprising the step of milling said scroll wrap portions to a desired height.

4. A scroll member for a scroll compressor, said scroll member comprising:

a base plate; and an upstanding involute wrap cast with said base plate, said wrap having a radially inner wrap portion and a radially outer wrap portion, said radially inner wrap portion formed from a softer material than said radially outer wrap portion.

5. The scroll member of claim 4 in combination with a scroll compressor including a scroll compressor mechanism within a hermetically sealed housing, said compressor mechanism having a stationary frame member to which said base plate is fixedly mounted.

6. The scroll member of claim 4 in combination with a scroll compressor including a scroll compressor mechanism within a hermetically sealed housing, said compressor mechanism having drive means operably coupled to said base plate member for imparting orbiting motion to said scroll member.

7. A scroll member for a scroll compressor, said scroll member comprising:

a base plate of cast iron; and an upstanding involute wrap having radially inner wrap portions and radially outer wrap portions formed on said base plate by casting and unevenly cooling said base plate and said wrap, whereby said radially inner wrap portions are softer than said radially outer wrap portions.

8. The scroll member of claim 7 in combination with a scroll compressor including a scroll compressor mechanism within a hermetically sealed housing, said compressor mechanism having a stationary frame member to which said base plate is fixedly mounted.

9. The scroll member of claim 7 in combination with a scroll compressor including a scroll compressor mechanism within a hermetically sealed housing, said compressor mechanism having drive means operably coupled to said base plate member for imparting orbiting motion to said scroll member.

* * * * *